US005120013A

United States Patent [19]

Sweeney

[11] Patent Number: 5,120,013

[45] Date of Patent: Jun. 9, 1992

[54] LADDER SHELF

[76] Inventor: Larry L. Sweeney, 422 W. Haskell St. #15, Winnemucca, Nev. 89445

[21] Appl. No.: 646,813

[22] Filed: Jan. 28, 1991

[51] Int. Cl.[5] ..... A47F 5/00

[52] U.S. Cl. ..... 248/238; 248/210; 182/129; 182/116

[58] Field of Search ..... 248/238, 210; 182/129, 182/214, 120, 116, 102

[56] References Cited

U.S. PATENT DOCUMENTS

| | | | |
|---|---|---|---|
| 1,257,056 | 2/1918 | Wheatley | 182/116 |
| 1,352,914 | 9/1920 | Plasclascovitie . | |
| 1,474,462 | 11/1923 | Blankenhagen | 182/121 |
| 2,553,322 | 5/1951 | Kurmer . | |
| 2,930,442 | 3/1960 | Carter . | |
| 3,131,928 | 5/1964 | Whipple | 182/129 X |
| 3,139,154 | 6/1964 | Ewald | 182/129 X |
| 3,208,555 | 9/1965 | Fry | 182/116 |
| 4,212,371 | 7/1980 | Gaviorno, Jr. . | |
| 4,418,793 | 12/1983 | Brent . | |
| 4,569,449 | 2/1986 | Brent | 182/129 X |

*Primary Examiner*—Karen J. Chotkowski

[57] ABSTRACT

A shelf assembly for a step ladder has two upright telescoping arms. Each arm has a lower tube and an upper tube telescoped into the lower tube to allow for a change in the length of the arm. This allows the shelf assembly to be vertically extended to raise a generally horizontal platform mounted on the upper ends of the arms to a desired height relative to the top of the step ladder. A folding bracket holds the shelf in a generally horizontal position. A ball joint mounted on a channel iron connects the lower end of each arm to a leg of the ladder. A linkage connects the middle of each arm to the ladder above the ball joint. A sleeve slides on each arm to provide adjustment of the linkage relative to the leg. The linkage has two connected links that allow the arms to be folded up against the ladder legs.

22 Claims, 3 Drawing Sheets

Fig. 1

LADDER SHELF

The invention relates to shelf assemblies or support platforms usable with ladders to hold implements and cans of materials such as paint.

BACKGROUND OF THE INVENTION

Prior ladder attachment devices show that it is known to use auxiliary shelves in association with step ladders and rung ladders. An example of this structure is shown by Gaviorno, Jr. in U.S. Pat. No. 4,212,371. This device has a pair of upright arms that are hooked onto the rungs of a ladder. A horizontal shelf is attached to the top of the arms. An angle brace retains the shelf in a horizontal position. The device can be folded for transportation or storage. Brent, in U.S. Pat. No. 4,418,793, discloses an auxiliary shelf for a step ladder. The shelf has a single leg that is attached to the ladder side rail with an adjusting structure that allows for the changing of the height of the shelf.

SUMMARY OF THE INVENTION

The invention is directed to a step ladder shelf assembly that can be raised or lowered to a selected height so that a worker standing on the ladder does not have to bend over to take tools, items or material from a container positioned on the shelf. The assembly can be attached to different types and sizes of step ladders.

The shelf assembly comprises a flat base pivotally mounted on a pair of upright telescoping arms. Each arm has a lower tube and an upper tube telescoped into the lower tube to allow for a change in the length of the arms whereby the base can be vertically raised or lowered to a desired height. A worker can position the base in a convenient location so as to avoid bending and reaching for items and materials supported by the base. A locking collar is mounted on the upper end of each lower tube. A fastener extends through the collar and engages the upper tube to lock the position of the upper tube relative to the lower tube. A ball joint mounted on the lower portion of the ladder pivotally mounts each arm to a leg of the ladder. The ball joints are carried by channel irons that are held to the ladder legs with clamps. This structure allows the shelf assembly to be attached to different types and sizes of ladders. A folding bracket releasably holds the base in a generally horizontal position. The base is hinged to the upper ends of the arms whereby the base can be folded to a position adjacent the arms when the assembly is stored or transported. A linkage connects the middle of each arm to a leg of the ladder above the ball joint. A sleeve slidably located on each arm is pivotally attached to one end of the linkage to provide adjustment of the linkage relative to the leg of the ladder. The opposite end of the linkage is pivotally connected to a loop mounted on the ladder leg. The linkage can pivot relative to the sleeve and the loop allowing the arm to be folded up against the ladder leg. The upper tube accommodated by a slot in the lower tube. The pin is engageable with a closed end of the slot to prevent separation of the upper tube from the lower tube.

DESCRIPTIPN OF THE PREFERRED EMBODIMENT

Figure 1:
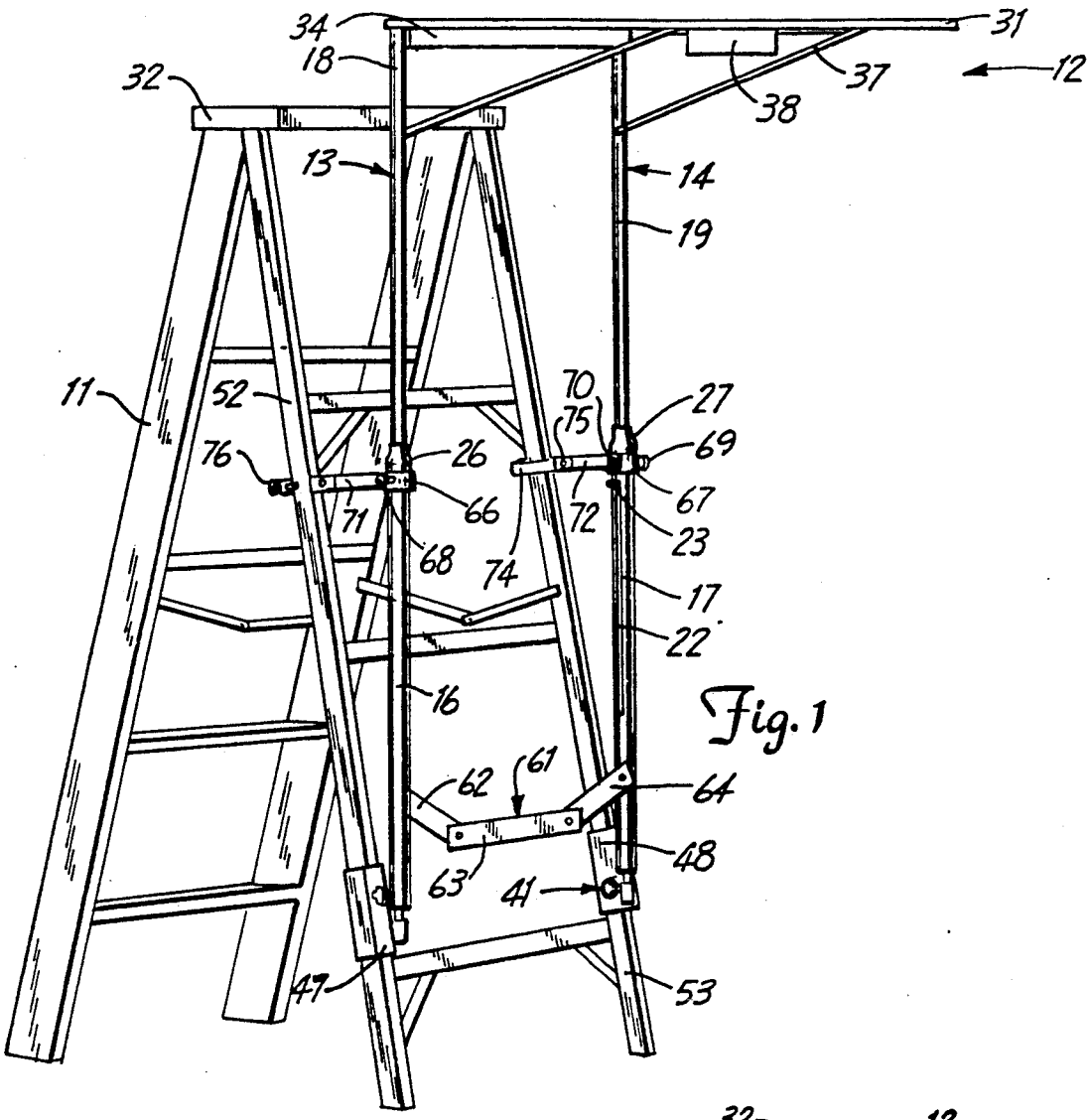
FIG. 1 is an enlarged front perspective view of the ladder shelf assembly of the invention mounted on a step ladder in its extended position.
Figure 2:
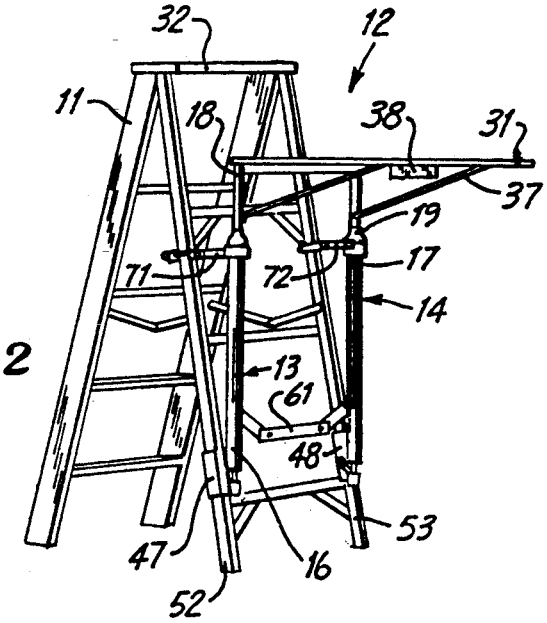
FIG. 2 is a front perspective view of the shelf assembly of FIG. 1 mounted on a step ladder in its contracted position.
Figure 3:
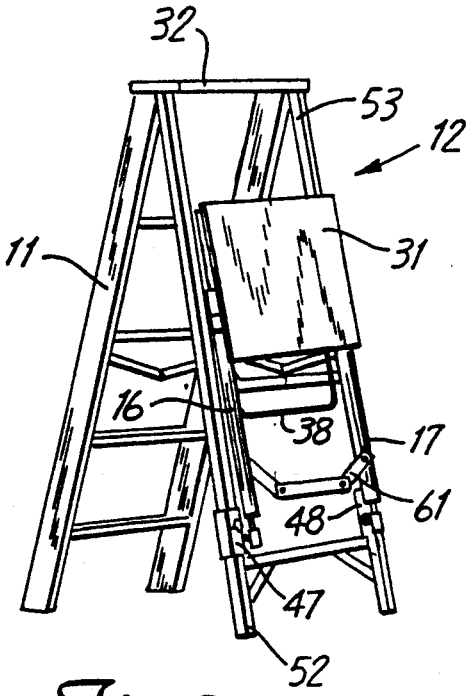
FIG. 3 is a front perspective view of the shelf assembly of FIG. 1 mounted on a step ladder in its folded position.

Referring to FIGS. 1 to 3, there is shown the ladder shelf assembly of the invention indicated generally at 12 mounted on a step ladder 1. Shelf assembly 12 is adapted to hold implements and cans of materials, such as paint, at a selected height. This enables a worker standing on ladder 11 to avoid bending over and reaching to take paint from a paint can positioned on shelf assembly 12. Shelf assembly 12 is adapted to be mounted on various sizes and types of step ladders. When step ladder 11 is to be stored or transported, shelf assembly 12 can be folded up against ladder legs 52 and 53, as shown in FIG. 3.

Ladder shelf assembly 12 has a pair of generally upright arms 13 and 14 mountable on the legs 52 and 53 of a step ladder 11. Each arm 13, 14 has a lower tube 16, 17 and an upper tube 18, 19. Upper tubes 18 and 19 slidably telescope into lower tubes 16 and 17 allowing the longitudinal length of arms 13 and 14 to be adjusted. The lower end of each upper tube 18, 19 has an outwardly directed pin 23 located in an elongated slot 22 provided in each lower tube 16, 17. The outer ends of pins 23 are aligned with the outer surface of lower tubes 16 and 17. Pins 23 are engageable with the tops of slots 22 to prevent upper tubes 18 and 19 from being separated from lower tubes 16 and 17, as shown in FIG. 6.

Figure 4:
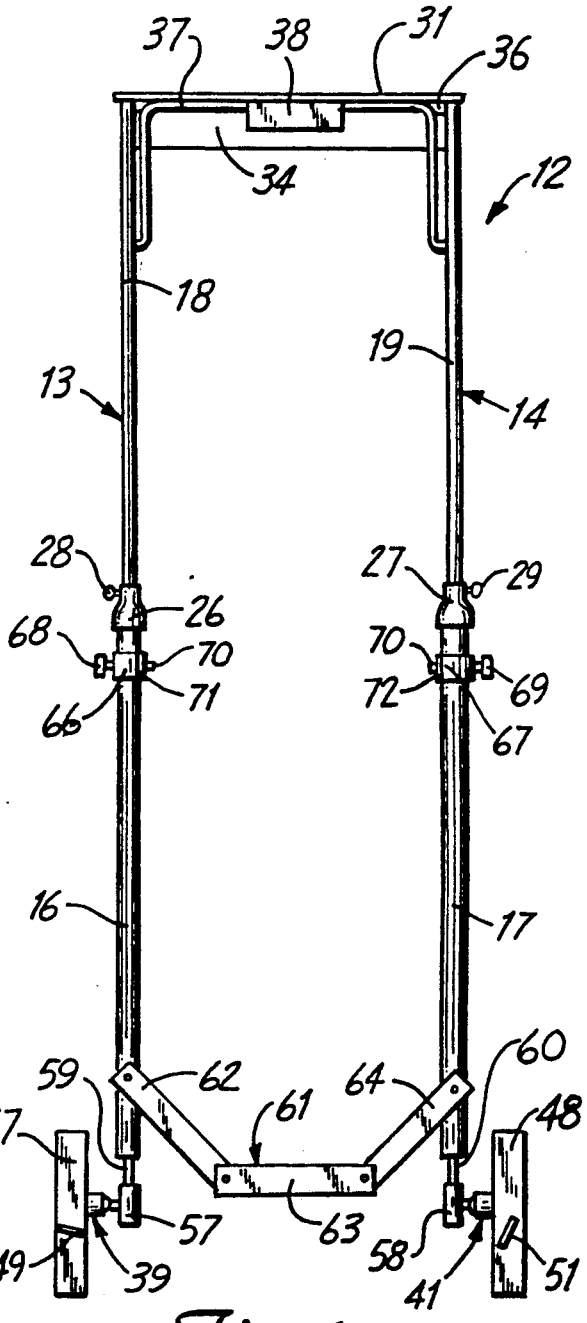
FIG. 4 is an enlarged front view of the shelf assembly of FIG. 1.
Figures 5, 6, 8:
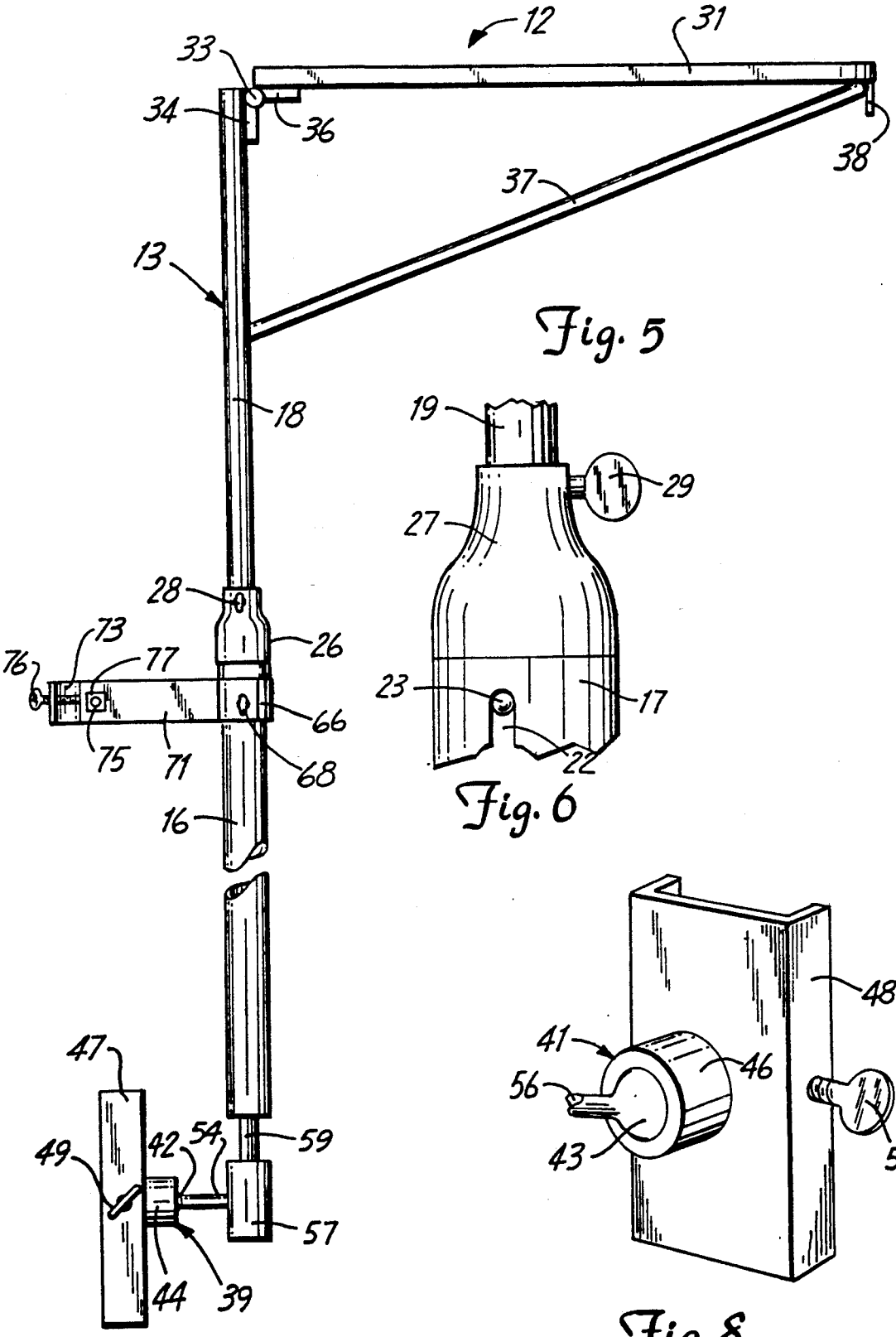
FIG. 5 is an enlarged side view of the shelf assembly of FIG. 1.
FIG. 6 is a fragmentary enlarged side view of one of the telescoping arms of the shelf assembly showing the locking collar.
FIG. 8 is a fragmentary enlarged front elevational view of one of the feet of the shelf assembly of FIG. 1.

Referring to FIGS. 4, 5 and 6, a tubular collar 26 is secured to the top of lower tube 16. Collar 26 has an upwardly and inwardly directed neck that accommodates upper tube 18. The lower section of collar 26 surrounds the top end of lower tube 16. The diameter of the neck is less than the diameter of the lower section of collar 26. A thumb screw 28 is threaded through a bore in the neck of collar 26 and engages an outer surface of the upper tube 18 to hold the upper tube is at a desired position relative to lower tube 16. A collar 27 identical to collar 26 is secured to the top of lower tube 17. Collar 27 has an upwardly and inwardly directed neck that accommodates upper tube 19 and a lower section that surrounds the top of lower tube 17. A thumb screw 29 extending through the neck of collar 27 engages upper tube 19 to hold the upper tube 19 at a desired position relative to lower tube 17.

A generally square platform 31 is pivotally attached to the top portions of arms 13 and 14 of ladder shelf assembly 12. Platform 31 is usable to support tools and containers of material, such as paint. A first transverse strip 34 extends between the tops of arms 13 and 14.

Strip 34 is connected with a hinge 33 to a second transverse strip 36 fastened to platform 31, as shown in FIG. 5. Hinge 33 enables platform 31 to be folded up against arms 13 and 14, as seen in FIG. 3. A U-shaped bracket 37 pivotally mounted on upper tubes 18 and 19 of arms 13 and 14 is used to releasably hold platform 31 in a generally horizontal position. The ends of bracket 37 are located in holes (not shown) provided in upper tubes 18 and 19. Platform 31 has a downwardly directed tab 38 that engages bracket 37 to hold platform 31 in the horizontal position. Bracket 37 is released from tab 38 by lifting platform 31 in an upward direction. The bracket 37 can then be pivoted toward arms 13 and 14 thereby allowing platform 31 to move to the folded position.

Figure 7:
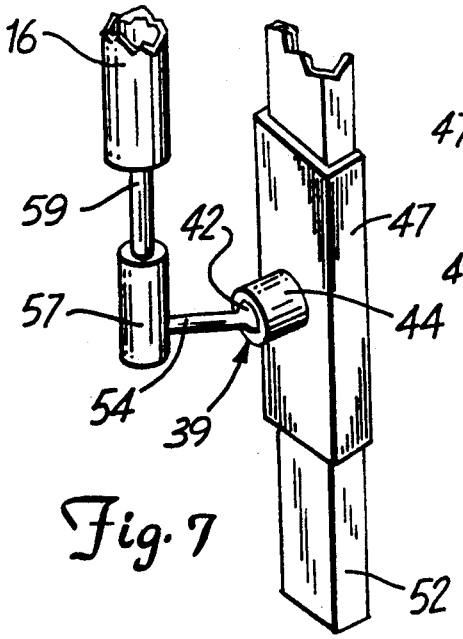
FIG. 7 is a fragmentary enlarged rear elevational view of the lower end of one of the arms of the shelf assembly mounted to a ladder leg.

Referring to FIGS. 5, 7 and 8, the lower ends of arms 13 and 14 are connected to clamps or feet 47 and 48 that are adapted to be mounted on legs 52 and 53 of ladder 11. Feet 47 and 48 are U-shaped channel irons having outwardly directed ends that extend over the front and back surfaces of ladder legs 52 and 53. A thumb screw 49, 51 is threaded through one of the ends of each foot 47, 48 and engages the front surface of each leg 52, 53, thereby locking feet 47 and 48 to the ladder legs. Each foot 47, 48 has a ball joint 39, 41 connecting the bottom ends of each lower tube 16, 17 to feet 47 and 48. Ball joints 39 and 41 have annular collars 44 and 46 that accommodate balls 42 and 43 for universal movement. A first shaft 54, 56 projects inwardly from each ball 42, 43 to a cylinder member 57, 58. Each cylinder 57, 58 is connected to the bottom of lower tube 16, 17 with a second upwardly directed shaft 59, 60. Ball joints 39 and 41 enable the lower ends of arms 13 and 14 to have universal movement relative to feet 47 and 48. The angular relationship between arms 13 and 14 and feet 47 and 48 can be adjusted so that the feet can be attached to legs 52 and 53 of ladder 11. Ball joints 39 and 41 also allow arms 13 and 14 to pivot relative to feet 47 and 48 whereby the arms may be moved away from and up against legs 52 and 53 of ladder 11.

Referring to FIGS. 1 and 4, a brace 61 extends between the lower sections of arms 13 and 14. Brace 61 has generally flat end links 62 and 64 pivotally attached to the ends of a generally flat middle link 63. The outer end of link 62 is pivotally connected to lower tube 16. The outer end of link 64 is pivotally connected to lower tube 17. Brace 61 allows the loWer ends of arms !3 and !4 to be moved in or out so that the lateral distance between feet 47 and 48 is substantially the same as the lateral distance between ladder legs 52 and 53. Ball joints 39 and 41 enable the angular relationship between arms 13 and 14 and feet 47 and 48 to be adjusted whereby the feet can be mounted on legs 52 and 53. Arms 13 and 14 can be adjusted to be mounted on ladder legs of ladders having different dimensions than the dimensions of ladder 11. The top sections 18 and 19 of arms 13 and 14 are pivotally attached to strip 34 whereby when the lower ends of the arms are moved in one direction, the top ends of the arms 13 and 14 pivot in the opposite direction. For example, when the lower ends of arms 13 and 14 are moved inwardly for attachment to a smaller sized ladder, the top ends of the arms pivot outwardly. This structure allows ladder shelf assembly 12 to be attached to different sizes and types of ladders.

Referring to FIGS. 1 and 5, each arm 13, 14 has a sleeve 66, 67 that surrounds a top section of each lower tube 16, 17 below locking collars 26 and 27. A thumb screw 68, 69 is threaded through each sleeve 66, 67 to engage loWer tube 16, 17 to hold the sleeve on the lower tube. A linkage 71, 72 connects the middle of each arm 13, 14 to ladder 11 below collars 26 and 27. The inner ends of linkages 71 and 72 are pivotally connected to sleeves 66 and 67 with fasteners 70, as seen in FIG. 4. Returning to FIG. 5, the outer end of each linkage 71, 72 is attached to a loop 73, 74 with a fastener assembly, such as a wing nut 75 and nut 77. Loops 73 and 74 are adapted to accommodate legs 52 and 53 of ladder 11. Thumb screws 76 threaded through loops 73 and 74 engage legs 52 and 53 to secure the loops to the ladder legs. Sleeves 66 and 67 are slidable on lower tubes 16 and 17 to adjust the position of linkages 71 and 72 and loops 73 and 74 relative to ladder legs 52 and 53. Pins 23 do not interfere with the sliding movement of sleeves 66 and 67. Preferably, sleeves 66 and 67 are positioned on lower tubes 16 and 17 so that linkages 71 and 72 extend horizontally to legs 52 and 53. Wing nuts 75 can be loosened from nuts 77 so that linkages 71 and 72 can pivot relative to sleeves 66 and 67 and loops 73 and 74 allowing arms 13 and 14 to be folded up against ladder legs 52 and 53.

In use, ladder shelf assembly 12 is mountable on the legs 52 and 53 of ladder 11. The lower ends of arms 13 and 14 are laterally adjusted whereby the horizontal distance between feet 47 and 48 is substantially the same as the horizontal distance between legs 52 and 53. End links 62 and 64 of brace 61 can pivot up or down to allow arms 13 and 14 to be laterally adjusted. Ball joints 39 and 41 enable feet 47 and 48 to be moved into alignment with the angular extension of ladder legs 52 and 53. Screws 49 and 51 are threaded through feet 47 and 48 to clamp the feet to the lower ends of legs 52 and 53. Arms 13 and 14 are then pivoted about ball joints 39 and 41 to a generally vertical or upright position. Sleeves 66 and 67 slide on lower tubes 16 and 17 to provide adjustment of the linkages 71 and 72 and loops 73 and 74 relative to legs 52 and 53 whereby the loops accommodate a portion of legs 52 and 53 above feet 47 and 48. Screws 76 are moved into engagement with legs 52 and 53 to attach loops 73 and 74 to the legs. Screws 68 and 69 are used to lock the position of sleeves 66 and 67 on lower tubes 16 and 17. Wing nuts 75 and nuts 77 are tightened to secure the outer ends of linkages 71 and 72 to loops 73 and 74 This holds arms 13 and 14 in a generally vertical or upright position.

Arms 13 and 14 can be adjusted by a work person so as to position platform 31 at a desired working height. Upper tubes 18 and 19 can be moved in or out relative to lower tubes 16 and 17 through locking collars 26 and 27 to extend or contract arms !3 and 14 as desired. Pins 23 move in slots 22 and are engageable with the closed ends of the slots thereby preventing upper tubes 18 and 19 from becoming separated from lower tubes 16 and 17. Collars 26 and 27 are secured to upper tubes 18 and 19 with thumb screws 28 and 29 to lock the position of upper tubes 18 and 19 relative to lower tubes 16 and 17. Platform 31 is pivoted about hinge 33 away from arms 13 and 14 to a generally horizontal position. U-shaped bracket 37 s swung upwardly so that the middle portion of bracket 37 engages tab 38 to releasably hold platform 31 in the horizontal position. The longitudinal length of arms 13 and 14 can be varied so as to adjust the horizontal position of platform 31 relative to the top step 32 of ladder 11. Arms 13 and 14 can be extended to locate platform 31 in a horizontal position above top step 32, as shown in FIG. 1. A worker standing on ladder 11 does not have to bend over and reach for tools and paint cans supported on platform 31. Arms 13 and 14 can be contracted so as to locate platform 31 in a horizontal position below top step 32, as shown in FIG. 2. This enables items supported on platform 31 to be accessible to a work person working adjacent ladder 11.

After use, the shelf assembly 12 can be collapsed to a folded or storage position adjacent ladder legs 52 and 53, as shown in FIG. 3. Shelf assembly 12 does not have to be removed from ladder 11 for storage. Collars 26 and 27 are unlocked from upper tubes 18 and 19 allowing the upper tubes 18 and 19 to slide into lower tubes 16 and 17. Platform 31 is moved upwardly to release bracket 37 from tab 38. Platform 31 and bracket 37 are then pivoted downwardly to a position adjacent arms 13 and 14. Wing nuts 75 are loosened from nuts 77 allowing linkages 71 and 72 to pivot relative to loops 73 and 74 and sleeves 66 and 67. Ball joints 39 and 41 cooperate with the pivotal movement of linkages 71 and 72 to enable arms 13 and 14 to be folded up against legs 52 and 53. Ladder 11 and shelf assembly 12 can then be transported or stored for subsequent use.

Ladder shelf assembly 12 is a versatile structure attachable to various sized ladders Shelf assembly 12 is adapted to be adjusted so as to facilitate repair, maintenance and painting projects, and the like.

While there has been shown and described a preferred embodiment of the ladder shelf assembly, it is understood that changes in the structure, materials, and arrangement of structure can be made by those skilled in the art without departing from the invention. The invention is defined in the following claims.

I claim:

1. A shelf assembly for a ladder including legs comprising: a base mounted on a pair of arms, each arm having a lower section and an upper section slidably received by the lower section to allow for a change in the length of the arm so as to move the base to a desired height, and joint means secured to each arm adapted to pivotally mount the arm to a leg of the ladder, the joint means including a universal ball joint connected to a lower end of the arm, and clamp means secured to the universal ball joint attachable to the leg, the clamp means comprising a generally U-shaped member having a base member accommodating a fastener, the fastener engageable with the leg to hold the U-shaped member on the leg.

2. The assembly of claim 1 including: locking means mounted on an upper end of the lower section accommodating the upper section, the locking means including fastening means engageable with the upper section to lock the position of the upper section relative to the lower section.

3. The assembly of claim 2 wherein: the locking means comprises a tubular member having an upwardly and inwardly directed neck accommodating the upper section and an annular lower portion secured to the upper end, the fastening means extending through the neck and engageable with the upper section.

4. The assembly of claim 1 including: hinge means pivotally connecting the base to upper ends of the arms, and bracket means pivotally mounted on the arms for releasably holding the base normal to the longitudinal axis of the arms.

5. The assembly of claim 4 wherein: the bracket means is a generally U-shaped rod, each arm having a hole accommodating an end of the rod, the base having a downwardly directed tab engageable with the rod to hold the base in an extended position.

6. The assembly of claim 1 including: link means connecting a middle portion or each arm to the leg adjacent the joint means, the link means adapted to allow the arm to be folded up against the leg.

7. The assembly of claim 6 wherein: the link means includes a linkage having an inner end and an outer end, a tubular sleeve slidably located on the arm and pivotally connected to the inner end, and a loop member adapted to be attached to the leg secured to the outer end with a releasable fastener assembly whereby when the fastener assembly is released, the linkage can pivot relative to the sleeve and loop member allowing the arm to be folded up against the leg.

8. The assembly of claim 1 wherein: the upper section has an outwardly directed pin accommodated by a slot in the lower section, the pin engageable with a closed end of the slot thereby preventing the upper section from being separated from the lower section.

9. A shelf assembly usable with a ladder comprising: a pair of telescoping arms, a platform mounted on the pair of telescoping arms, each arm having a bottom section and a top section slidably received by the bottom section to allow for a change in length of the arm thereby moving the platform to a desired height, locking means mounted on an upper end of the bottom section accommodating the top section, the locking means including fastening means engageable with the top section to lock the position of the top section relative to the bottom section, the top and bottom sections having means preventing separation of the top section from the bottom section, link means connecting a middle portion of each arm to a leg of a ladder and adapted to allow the arm to be folded up against the leg, and joint means secured to clamp means pivotally mounting a lower end of each arm to the leg, the joint means including a universal ball joint connected to the lower end of the arm and the clamp means.

10. The assembly of claim 9 wherein: the clamp means comprises a generally U-shaped channel member having a bore accommodating a fastener, the fastener engageable with the leg to hold the member on the leg.

11. The assembly of claim 9 wherein: the locking means comprises a tubular member having an upwardly and inwardly directed neck accommodating the top section and an annular lower portion secured to the upper end of the bottom section, the fastening means projecting through the neck and engageable with the top section.

12. The assembly of claim 9 including: hinge means pivotally connecting the platform to upper ends of the arms, and bracket means pivotally mounted on the arms operable to releasably hold the platform normal to the longitudinal axis of the arms, the platform having stop means engageable with the bracket means to hold the platform in an extended position.

13. The assembly of claim 9 wherein: the link means includes a linkage having an inner end and an outer end, a tubular sleeve slidably located on the arm and pivotally connected to the inner end, fastener means extending through the sleeve and engageable with the arm to releasably hold the sleeve on the arm, and a loop member attachable to the leg secured to the outer end with a releasable fastener assembly whereby when the fastener assembly is released, the linkage can pivot relative to the sleeve and loop member allowing the arm to be folded up against the leg.

14. The assembly of claim 9 wherein: the means preventing separation of the top section from the bottom section includes an outwardly directed pin secured to a lower end of the top section, the pin accommodated by a longitudinal slot in the bottom section, the slot having a closed top end, the pin engageable with the closed end to prevent separation of the top section from the bottom section.

15. A shelf assembly for a step ladder comprising: a pair of transversely spaced telescoping arms, a generally flat platform pivotally mounted on the pair of transversely spaced telescoping arms, bracket means mounted on the arms operable to releasably hold the platform in an extended position, locking means mounted on each arm adapted to maintain a desired length of the arm, joint means mounted on clamp means pivotally connecting a lower end of each arm to a leg of a ladder, the joint means including a universal ball joint connected to the lower end of the arm and the clamp means, the clamp means comprising a generally U-shaped channel member having a base accommodating a fastener, the fastener engageable with the leg to hold the channel member of the leg, and link means connecting a middle portion of each arm to the leg, the link means and joint means cooperating to allow the arm to be moved to a folded position adjacent the leg.

16. The assembly of claim 15 wherein: each arm has a bottom tube and top tube slidably received by the bottom tube whereby the longitudinal length of the arm can be changed to position the platform at a desired height.

17. The assembly of claim 16 wherein: the locking means includes a generally tubular member mounted on an upper end of each bottom tube, the tubular member having an upwardly and inwardly directed neck accommodating the top tube, and fastening means extended through the neck and engageable with the top tube to lock the position of the top tube relative to the bottom tube.

18. The assembly of claim 16 wherein: the top tube has an outwardly directed pin accommodated by a slot in the lower tube, the pin engageable with a closed end of the slot to prevent separation of the top tube from the bottom tube.

19. The assembly of claim 15 wherein: the link means includes a linkage having an inner end and an outer end, a tubular sleeve slidably mounted on the arm and pivotally connected to the inner end, fastener means extended through the sleeve and engageable with the arm to releasably hold the sleeve on the arm, and a loop member for accommodating the leg secured to the outer end with a releasable fastener assembly whereby when the fastener assembly is released, the linkage can pivot relative to the sleeve and loop member, allowing the arm to pivot about the universal ball joint to a folded position adjacent the leg.

20. The assembly of claim 15 wherein: the universal ball joint has an annular collar secured to the channel member pivotally accommodating a ball, and an L-shaped member extending between the ball and the lower end of the arm.

21. A shelf assembly for a step ladder comprising: a pair of transversely spaced telescoping arms, a generally flat platform mounted on a pair of transversely spaced telescoping arms, each arm having a bottom tube and a top tube slidably received by the bottom tube whereby the longitudinal length of the arm can be changed to position the platform at a desired height, hinge means pivotally connecting the platform to upper ends of the top tubes, bracket means mounted on the top tubes engageable with stop means secured to the platform to releasably hold the platform in an extended position, a tubular member mounted on an upper end of each bottom tube having an upwardly and inwardly directed neck accommodating the top tube, fastening means extending through the neck and engageable with the top tube to lock the position of the top tube relative to the bottom tube, the top and bottom tubes having means preventing separation of the top tube from the bottom tube, link means connecting each lower tube to a leg of a ladder, the link means including a linkage having an inner end and an outer end, a tubular sleeve slidably mounted on the lower tube and pivotally connected to the inner end, fastener means extending through the sleeve and engageable with the lower tube to releasably hold the sleeve on the lower tube, and a loop member attachable to the leg secured to the outer end with a releaseable fastener assembly whereby when the fastener assembly is released, the linkage can pivot relative to the sleeve and loop member allowing the arm to be folded up against the leg, and a universal ball joint connected to a lower end of each lower tube and clamp means, the clamp means attachable to the leg thereby pivotally mounted the lower end of the lower tube to the leg.

22. The assembly of claim 21 wherein: the clamp means comprises a generally U-shaped channel member, the universal ball joint having an annular collar secured to the channel member pivotally accommodating a ball, and an L-shaped member extended between the ball and the lower end of the lower tube.

* * * * *